US011040539B2

(12) United States Patent
Shiratori et al.

(10) Patent No.: US 11,040,539 B2
(45) Date of Patent: Jun. 22, 2021

(54) PRINTING SYSTEM, SERVER, AND CONTROL METHOD OF PRINTING SYSTEM

(71) Applicant: SEIKO EPSON CORPORATION, Tokyo (JP)

(72) Inventors: Kohei Shiratori, Matsumoto (JP); Hiroyuki Kuramoto, Shiojiri (JP); Norihiko Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/796,715

(22) Filed: Feb. 20, 2020

(65) Prior Publication Data

US 2020/0269583 A1 Aug. 27, 2020

(30) Foreign Application Priority Data

Feb. 22, 2019 (JP) ..... JP2019-030747

(51) Int. Cl.
*B41J 2/165* (2006.01)

(52) U.S. Cl.
CPC .. *B41J 2/16523* (2013.01); *B41J 2002/16573* (2013.01)

(58) Field of Classification Search
CPC ..... B41J 2/16523; B41J 2002/16573
See application file for complete search history.

(56) References Cited

U.S. PATENT DOCUMENTS

2015/0070416 A1* 3/2015 Ejiri ..... B41J 2/17566 347/7
2018/0059996 A1* 3/2018 Ishizu ..... G06F 3/1234
2018/0267756 A1* 9/2018 Lee ..... G06F 3/1229
2018/0281444 A1 10/2018 Wada et al.

FOREIGN PATENT DOCUMENTS

CN 108688319 A * 10/2018 ..... B41J 29/02
JP 2017-209851 11/2017
JP 2018-171815 11/2018

* cited by examiner

*Primary Examiner* — Sharon Polk
(74) *Attorney, Agent, or Firm* — Workman Nydegger

(57) ABSTRACT

The first printing system SY1 includes a printing apparatus 4 including an ink container and a server 2 coupled to the printing apparatus 4 via a network NW, wherein the server 2 acquires maintenance information including residual ink amount information indicating an residual amount of ink in the ink container of the printing apparatus 4, determines whether a maintenance process is configured to be performed based on the acquired maintenance information, and instructs the printing apparatus 4 to perform the maintenance process when it is determined that the maintenance process is configured to be performed.

8 Claims, 11 Drawing Sheets

PRINTING SYSTEM, SERVER, AND CONTROL METHOD OF PRINTING SYSTEM

The present application is based on, and claims priority from JP Application Serial Number 2019-030747, filed Feb. 22, 2019, the disclosure of which is hereby incorporated by reference herein in its entirety.

BACKGROUND

1. Technical Field

The present disclosure relates to a printing system, a server, and a control method of the printing system.

2. Related Art

In the related art, as shown in JP-A-2017-209851, a technique of an ink jet printing apparatus is known, in which the residual amount of ink in the ink container such as an ink cartridge is detected before performing the maintenance process, and when the residual ink amount is lower than the amount of ink consumed by the maintenance process, a user is prompted to replace the ink cartridge by the LED provided in the printing apparatus blinked in a predetermined pattern.

In the technology disclosed in JP-A-2017-209851, when a user is located away from a printing apparatus, in other words, when the user wants the printing apparatus at a remote location to perform a maintenance process, the user cannot validate the blinking of the LED, so that the user can not perform the maintenance process.

SUMMARY

According to an aspect of the present disclosure, a printing system includes a printing apparatus including an ink container, and a server coupled to the printing apparatus via a network, wherein the server includes a controller that acquires maintenance information including residual ink amount information indicating an residual amount of ink in the ink container of the printing apparatus, determines whether a maintenance process is configured to be performed based on the acquired maintenance information, and instructs the printing apparatus to perform the maintenance process when it is determined that the maintenance process is configured to be performed.

According to an aspect of the present disclosure, a server is coupled to a printing apparatus including an ink container via a network, wherein the server includes a controller that acquires maintenance information including residual ink amount information indicating an residual amount of ink in the ink container of the printing apparatus, determines whether a maintenance process is configured to be performed based on the acquired maintenance information, and instructs the printing apparatus to perform the maintenance process when it is determined that the maintenance process is configured to be performed.

According to an aspect of the present disclosure, a method of controlling a printing system, where the printing system includes a printing apparatus including an ink container and a server coupled to the printing apparatus via a network, wherein the server performs the method, the method comprising: acquiring maintenance information including residual ink amount information indicating an residual amount of ink in the ink container of the printing apparatus, determining whether a maintenance process is configured to be performed based on the acquired maintenance information, and instructing the printing apparatus to perform the maintenance process when it is determined that the maintenance process is configured to be performed.

According to an aspect of the present disclosure, in a non-transitory computer-readable storage medium storing a program, the program causes a server coupled to a printing apparatus including an ink container via a network to acquire maintenance information including residual ink amount information indicating an residual amount of ink in the ink container of the printing apparatus, determine whether a maintenance process is configured to be performed based on the acquired maintenance information, and instruct the printing apparatus to perform the maintenance process when it is determined that the maintenance process is configured to be performed.

DESCRIPTION OF EXEMPLARY EMBODIMENTS

First Embodiment

Figure 1:
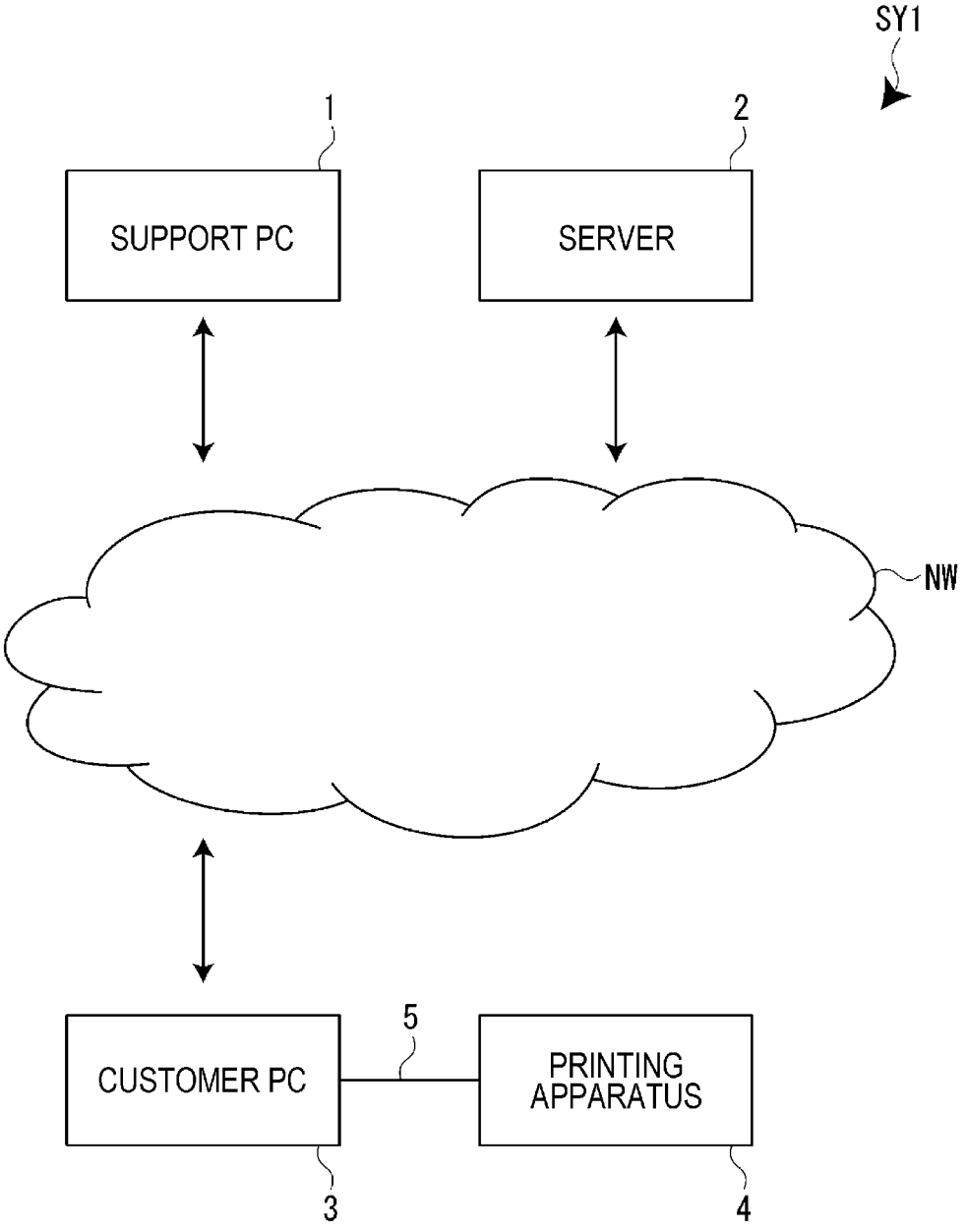
FIG. 1 is a system configuration diagram of a first printing system.

Hereinafter, a printing system, a server, a control method of the printing system, and a program according to an embodiment will be described with reference to the accompanying drawings. FIG. 1 is a system configuration diagram of a first printing system SY1. The first printing system SY1 includes a support personal computer (PC) 1, a server 2, a customer PC3, and a printing apparatus 4. The support PC1, the server 2, and the customer PC3 are coupled via a network NW. The customer PC3 and the printing apparatus 4 are coupled via a communication line 5. The communication line 5 may be a dedicated line such as a cable or a network line such as a local area network (LAN). The network NW is assumed to be an Internet communication network in the present embodiment, but may be a network line such as a LAN.

In the figure, an example is shown in which one support PC1 and one customer PC3 are coupled to one server 2, but a configuration in which a plurality of support PCs 1 and a plurality of customer PCs 3 are coupled to one server 2 may be used. A configuration in which a plurality of printing apparatuses 4 is coupled to one customer PC3 may also be used.

In the present embodiment, the printing apparatus 4 is assumed to be an ink jet printer. The printing apparatus 4 may be a printer having only a printing function, or may be a multifunction machine having a copy function and a scanner function in addition to the printing function.

In the first printing system SY1, the customer PC3 and the printing apparatus 4 are installed on the customer side such as a company or a store. The customer PC3 acts as an intermediary between the server 2 and the printing apparatus 4. On the other hand, the support PC1 and the server 2 are terminals on the service provider side that provide support services for the printing apparatus 4 to customers. The service provider performs, for example, a service related to maintenance and billing of the printing apparatus 4 as a support service. In order to implement these services, the server 2 collects various pieces of information of the printing apparatus 4 via the customer PC3. For example, the server 2 collects information indicating the residual amount of an ink cartridge 62 (see FIG. 6) as an example of an ink container provided in the printing apparatus 4, the free capacity of a maintenance box 78 (see FIG. 6), the status of the printing apparatus 4, and the number of printed sheets for color printing/monochrome printing and for single-sided printing/double-sided printing.

Of the information of the printing apparatus 4 collected by the server 2, information indicating the residual amount of the ink cartridge 62 is hereinafter referred to as "residual ink amount information". Information indicating the free capacity of the maintenance box 78 is referred to as "free capacity information". Further, the residual ink amount information and the free capacity information are hereinafter collectively referred to as "maintenance information".

When the maintenance process is instructed from the support PC1, the server 2 acquires the maintenance information of the printing apparatus 4 via the customer PC3, and determines whether the maintenance process can be performed based on the acquired maintenance information. When the server 2 determines that the maintenance process can be performed, the server 2 instructs the customer PC3 to perform the maintenance process of the printing apparatus 4 from which the maintenance information has been acquired.

Figure 2:
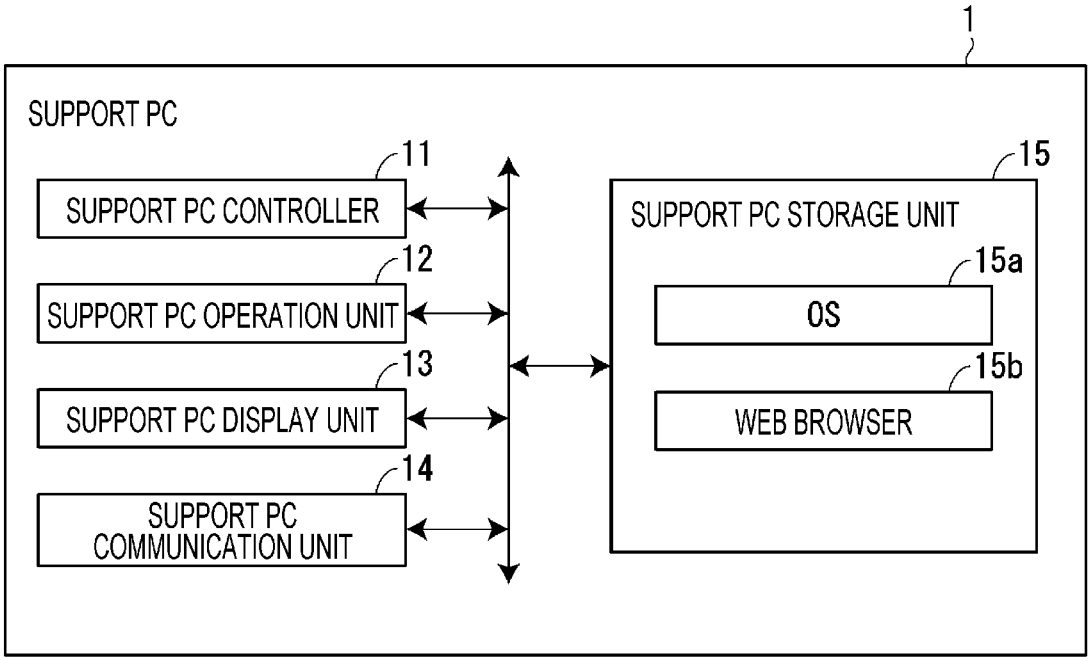
FIG. 2 is a block diagram illustrating a hardware configuration of a support PC.

Next, the hardware configuration of the support PC1, the server 2, the customer PC3, and the printing apparatus 4 will be described with reference to FIGS. 2 to 5. FIG. 2 is a block diagram illustrating a hardware configuration of the support PC1. The support PC1 includes a support PC controller 11, a support PC operation unit 12, a support PC display unit 13, a support PC communication unit 14, and a support PC storage unit 15.

The support PC controller 11 includes a read only memory (ROM), a random access memory (RAM), and the like in addition to a processor such as a central processing unit (CPU), and controls respective units in the support PC1. The support PC operation unit 12 refers to, for example, a keyboard or a mouse, and is used for operations such as the designation of the printing apparatus 4 on which the maintenance process is to be performed and the instruction of the maintenance process to the designated printing apparatus 4. The support PC display unit 13 refers to, for example, a liquid crystal display and displays various pieces of information such as an error display screen D (see FIG. 8). The support PC communication unit 14 communicates with the server 2 via the network NW.

The support PC storage unit 15 refers to, for example, a hard disk drive (HDD) and stores an operating system (OS) 15*a*, a WEB browser 15*b*, and the like. The OS 15*a* is basic software for operating various application programs. The WEB browser 15*b* is an application program for displaying a WEB page. Using the WEB browser 15*b*, the support PC controller 11 displays, on the support PC display unit 13, various pieces of information such as the error display screen D that the server 2 provides as a WEB page.

Figure 3:
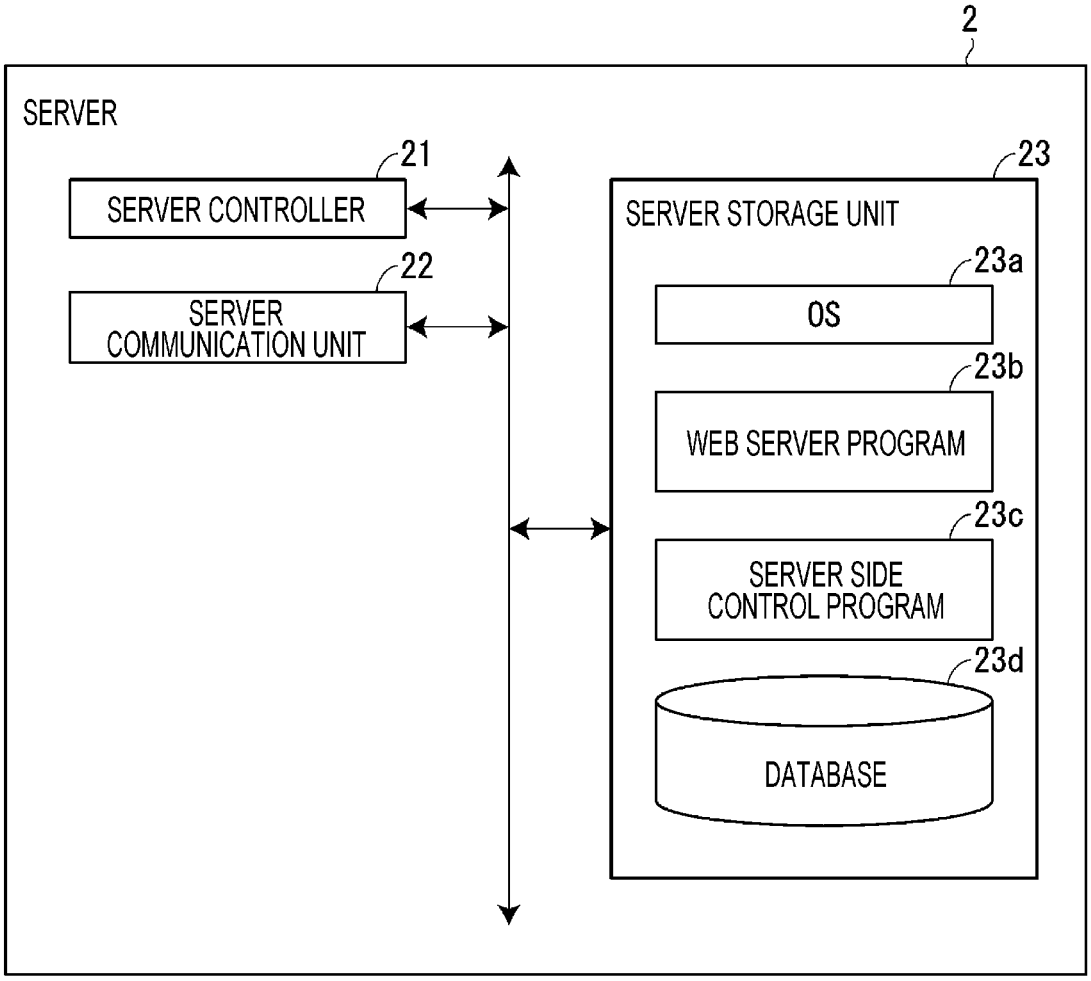
FIG. 3 is a block diagram illustrating a hardware configuration of a server.

FIG. 3 is a block diagram illustrating a hardware configuration of the server 2. The server 2 includes a server controller 21, a server communication unit 22, and a server storage unit 23. The server controller 21 is an example of a "controller".

The server controller 21 includes a processor such as a CPU, a ROM and a RAM, and controls respective units in the server 2. The server communication unit 22 communicates with the support PC1 and the customer PC3 via the network NW.

The server storage unit 23 refers to, for example, an HDD, and stores an OS 23*a*, a WEB server program 23*b*, a server side control program 23*c*, a database 23*d*, and the like. The OS 23*a* is basic software for operating various application programs. The WEB server program 23*b* is an application program for the server 2 to function as a WEB server. The server controller 21 generates a WEB page using this WEB server program 23*b*.

The server side control program 23*c* is an application program for communicating with the customer PC and controlling the printing apparatus 4 in cooperation with the customer PC. The server controller 21 collects various pieces of information of the printing apparatus 4 using the server side control program 23*c*, and stores the collected information in the database 23*d*. Using the server side control program 23*c*, the server controller 21 instructs the customer PC to collect the maintenance information of the printing apparatus 4, determines whether the maintenance process can be performed based on the maintenance information acquired from customer PC, and when it is determined that the maintenance process can be performed, instructs the customer PC to perform the maintenance process of the printing apparatus 4.

The database 23*d* stores various pieces of information collected from the printing apparatus 4. The information stored in the database 23*d* may be collected periodically or may be collected at a predetermined time from the printing apparatus 4. The information stored in the database 23*d* includes the maintenance information, and when the maintenance process is instructed from the support PC1, the customer PC is instructed to collect maintenance information regardless of the information collection timing for storing in the database 23*d*.

The database 23*d* stores a printing apparatus table in which the address of the customer PC3 that is capable of communicating with the server 2 is associated with the device name and the device ID of the printing apparatus 4 coupled to the customer PC3. The server controller 21 refers to the printing apparatus table and provides the support PC1 with a device name list for the printing apparatus 4 as a WEB page, thereby accepting the designation of the printing apparatus 4 on which the maintenance process is to be performed. The printing apparatus 4 on which the maintenance process is to be performed is hereinafter referred to as the "target printing apparatus 4". In addition, when the server controller 21 accepts the designation of the target printing apparatus 4, the server controller 21 designates the device ID of the designated target printing apparatus 4 and instructs the customer PC3 addressed in association with the device ID to collect maintenance information.

Figure 4:
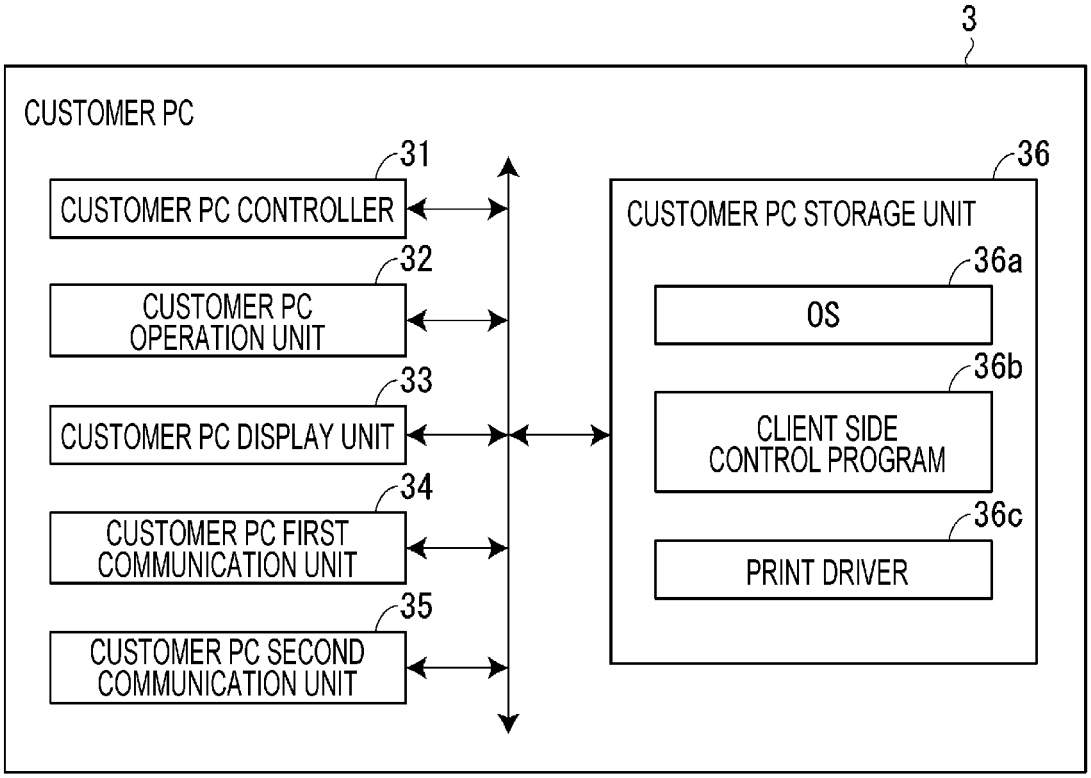
FIG. 4 is a block diagram illustrating a hardware configuration of a customer PC.

FIG. 4 is a block diagram illustrating a hardware configuration of the customer PC3. The customer PC3 includes a customer PC controller 31, a customer PC operation unit 32, a customer PC display unit 33, a customer PC first communication unit 34, a customer PC second communication unit 35, and a customer PC storage unit 36.

The customer PC controller 31 includes a processor such as a CPU, a ROM and a RAM, and controls respective units in the customer PC3. The customer PC operation unit 32 refers to, for example, a keyboard or a mouse, and is used for operations or generating print data to be transmitted to the printing apparatus 4, issuing a print instruction to the printing apparatus 4, and the like. The customer PC display unit 33 refers to, for example, a liquid crystal display and displays various pieces of information such as an editing screen (not shown) for editing print data. The customer PC first communication unit 34 communicates with the server 2 via the network NW. The customer PC second communication unit 35 communicates with the printing apparatus 4 via the communication line 5.

The customer PC storage unit 36 refers to, for example, an HDD, and stores an OS 36*a*, a client side control program 36*b*, a print driver 36*c*, and the like. The OS 36*a* is basic software for operating various application programs. The client side control program 36*b* is an application program for communicating with the server 2. The customer PC controller 31 communicates with the server 2 using this client side control program 36*b*, and performs control to collect various pieces of information from the printing apparatus 4, cause the printing apparatus 4 to perform the maintenance process, and the like.

The print driver 36*c* is a control program for performing print control on the printing apparatus 4. The customer PC controller 31 performs, using the print driver 36*c*, control to generate print data of a command system readable by the printing apparatus 4, acquire the status of the printing apparatus 4, and the like. The status acquisition may be performed using the client side control program 36*b* instead of using the print driver 36*c*.

Figure 5:
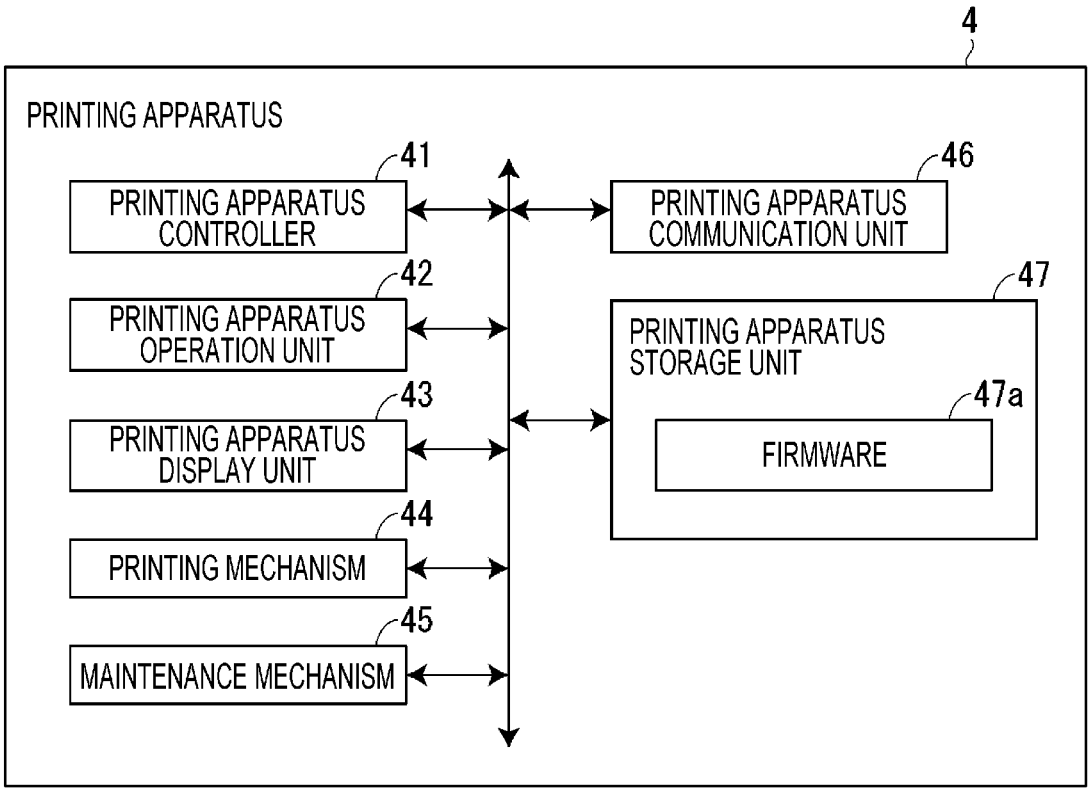
FIG. 5 is a block diagram illustrating a hardware configuration of a printing apparatus.

FIG. 5 is a block diagram illustrating a hardware configuration of the printing apparatus 4. The printing apparatus 4 includes a printing apparatus controller 41, a printing apparatus operation unit 42, a printing apparatus display unit 43, a printing mechanism 44, a maintenance mechanism 45, and a printing apparatus communication unit 46, a printing apparatus storage unit 47.

The printing apparatus controller 41 includes a processor such as a CPU, a ROM, a RAM, and the like, and controls respective units in the printing apparatus 4. The printing apparatus operation unit 42 refers to, for example, an operation panel or various buttons, and is used by the user to perform various operations on the printing apparatus 4. The printing apparatus display unit 43 refers to, for example, an operation panel, and displays various pieces of information such as the residual amount of the ink cartridge 62 and the status of the printing apparatus 4.

The printing mechanism 44 is a mechanism that performs printing on a print medium such as copy paper. The printing mechanism 44 includes an ink jet print head 64 (see FIG. 6), a head drive mechanism that drives the print head 64, a print medium transport mechanism that transports the print medium, and the like.

The maintenance mechanism 45 is a mechanism for performing the maintenance process of the print head 64. Although details will be described later, the maintenance mechanism 45 includes a capping device 71 (see FIG. 6), the maintenance box 78 (see FIG. 6), and the like. In this embodiment, the maintenance mechanism 45 is used for performing a flushing process of ejecting ink in order to prevent ejection failure separately from image formation on the print medium from ink nozzles 66 (see FIG. 6) provided in the print head 64, and a suction process of sucking ink from the ink nozzles 66.

The printing apparatus communication unit 46 communicates with the customer PC3 via the communication line 5. The printing apparatus storage unit 47 refers to, for example, a flash memory, and stores firmware 47*a* and the like. The firmware 47*a* is a control program for controlling the printing apparatus 4. The printing apparatus controller 41 performs communication control with the customer PC3 and control of the printing mechanism 44 and the maintenance mechanism 45 using the firmware 47*a*.

Figure 6:
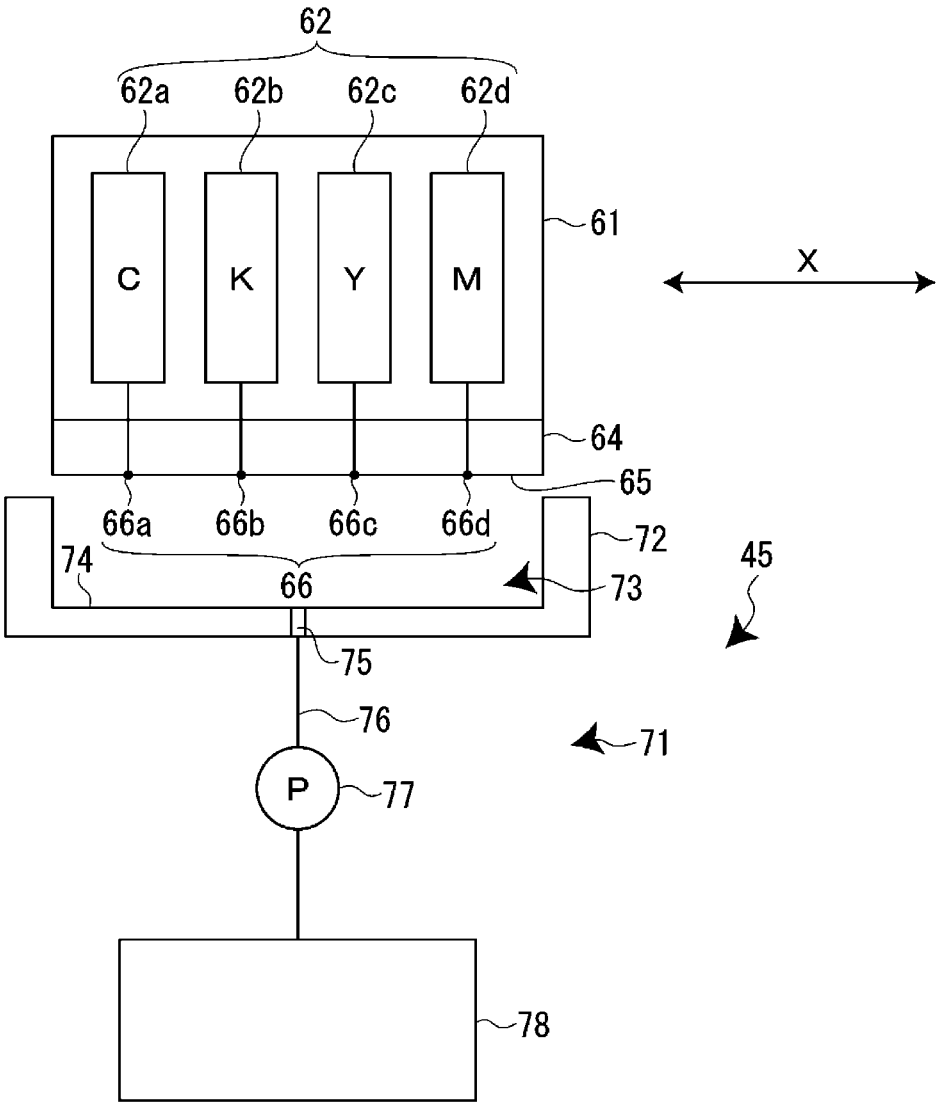
FIG. 6 is a schematic diagram of part of a printing mechanism and a maintenance mechanism of the printing apparatus.

Next, the printing mechanism 44 and the maintenance mechanism 45 of the printing apparatus 4 will be described with reference to FIG. 6. FIG. 6 is a schematic diagram of part of the printing mechanism 44 and the maintenance mechanism 45. As shown in the figure, the printing apparatus 4 includes, part of the printing mechanism 44, a carriage 61 capable of reciprocating in the main scanning direction indicated by an arrow X, and the print head 64 that is mounted on the carriage 61 and ejects ink onto the print medium as the carriage 61 moves.

In the present embodiment, the four-color ink cartridge 62 that store ink to be supplied to the print head 64 is mounted on the carriage 61. The ink cartridge 62 includes a cyan ink cartridge 62*a* storing cyan ink, a black ink cartridge 62*b* storing black ink, a yellow ink cartridge 62*c* storing yellow ink, and a magenta ink cartridge 62*d* storing magenta ink. Instead of mounting the ink cartridge 62 on the carriage 61, ink may be supplied from the ink cartridge 62 arranged at another location to the print head 64 via an ink tube.

The print head 64 is provided with a large number of the ink nozzles 66 that eject ink. The ink nozzles 66 are arranged as a plurality of nozzle rows on a lower face 65 of the print head 64, that is, the nozzle hole forming face. The ink nozzles 66 include a cyan nozzle row 66*a* for ejecting ink supplied from the cyan ink cartridge 62*a*, a black nozzle row 66*b* for ejecting ink supplied from the black ink cartridge 62*b*, a yellow nozzle row 66*c* for ejecting ink supplied from the yellow ink cartridge 62*c*, and a magenta nozzle row 66*d* for ejecting ink supplied from the magenta ink cartridge 62*d*.

The print head 64 is driven by an actuator configured using a piezo element, and changes the pressure in the cavity filled with the ink supplied from the ink cartridge 62 to eject ink from the ink nozzles 66 communicating with the cavity.

With the above configuration, the printing apparatus 4 forms an image on a print medium by performing a transport operation of transporting the print medium in the sub-scanning direction orthogonal to the main scanning direction by the print medium transport mechanism, and a printing operation of ejecting ink from the print head 64 while reciprocating the carriage 61 in the main scanning direction. On the other hand, the printing apparatus 4 moves the carriage 61 so that the print head 64 is positioned at the home position in a standby state in which no printing operation is performed. FIG. 6 shows a state in which the print head 64 is positioned at the home position. The capping device 71 is disposed immediately below the print head 64 positioned at the home position.

The printing apparatus 4 includes, as the maintenance mechanism 45, the capping device 71 and the maintenance box 78. The capping device 71 includes a box-shaped cap main body 72 having an open upper face, a waste ink tube 76 serving as a flow path of ink discharged from the cap main body 72, and a suction pump 77 that sucks ink. The cap main body 72 has a frame made of an elastic member, and the internal space of the cap main body 72 is a head storage space 73 for storing the print head 64. The cap main body 72 is configured to be movable up and down by a lifting device (not shown), and the print head 64 is stored in the head storage space 73 at the raised position.

A discharge hole 75 penetrating a lower face 74 is formed in the lower face 74 of the cap main body 72. The ink discharged from the discharge hole 75 is stored in the maintenance box 78 via the waste ink tube 76.

The printing apparatus 4 performs the maintenance process using the capping device 71 as described above. In the present embodiment, the printing apparatus 4 performs a flushing process and a suction process as the maintenance process. The order, processing time, the number of repetitions, and the like of the flushing process and the suction process in the maintenance process are based on a predetermined sequence. Therefore, the amount of ink consumed by the maintenance process is a predetermined amount, and the server 2 stores the amount of each color of ink consumed by the maintenance process as part of the server side control program 23*c*.

The flushing process is a process of performing waste ejection of ink from the ink nozzles 66 into the cap main body 72 in a state where the print head 64 is not stored in the head storage space 73. The ink collected in the head storage space 73 is discharged into the maintenance box 78 through the discharge hole 75 and the waste ink tube 76 by the suction of the suction pump 77. In this way, by performing the flushing process, it is possible to eliminate the ejection failure due to the increased viscosity of ink in the ink nozzles 66 and the ink supply path from the ink cartridge 62 to the ink nozzles 66.

On the other hand, the suction process is a process of sucking ink collected in the ink nozzles 66 in a state where the print head 64 is stored in the head storage space 73. When the suction pump 77 is driven in a state where the print head 64 is stored in the head storage space 73, air is sucked out from the ink nozzles 66. As a result, the inside of the ink nozzles 66 is in a negative pressure state, and the ink collected in the ink nozzles 66 is forcibly sucked.

Next, a flow of a series of processes when the first printing system SY1 causes the printing apparatus 4 to perform the above-described the maintenance process will be described with reference to a flowchart of FIG. 7. Here, it is assumed that a customer who has installed the printing apparatus 4 requests a service provider who provides a support service to perform a maintenance process, and starts a series of processes with the consent of both parties. In addition, it is assumed that an operator who operates the support PC1 performs a login operation and the like on the server 2 and can browse a WEB page provided from the server 2.

The support PC1 designates the target printing apparatus 4 on the maintenance process instruction screen (not shown) provided from the server 2 (S01), and instructs the maintenance process of the target printing apparatus 4 (S02). The server 2 identifies the target printing apparatus 4 designated by the support PC1 as a maintenance process target (S03), and instructs the customer PC3 to collect information on the target printing apparatus 4 (S04). At this time, the server 2 refers to the printing apparatus table stored in the database 23*d*, and regards the customer PC3 associated with the device ID of the target printing apparatus 4 specified by the support PC1 as the address to specify the device ID to instruct information collection.

The customer PC3 identifies the target printing apparatus 4 based on the device ID designated by the server 2 (S05), and collects maintenance information from the target printing apparatus 4 (S06). As described above, the customer PC3 collects residual ink amount information and free capacity information as maintenance information.

The residual ink amount information is information indicating the residual amount of each color of ink in the ink cartridge 62. That is, the residual ink amount information is information indicating the residual amount of ink in each of the cyan ink cartridge 62*a*, the black ink cartridge 62*b*, the yellow ink cartridge 62*c*, and the magenta ink cartridge 62*d*. Further, the residual ink amount information may indicate the residual ink amount by a relative value, such as the expression in which "XX %" of the ink remains with respect to the capacity of the ink cartridge 62, or may indicate the residual ink amount by an absolute value, such as the expression in which "XX cc" of the ink remains. The free capacity information may also indicate the free capacity of the maintenance box 78 by a relative value or an absolute value.

When the customer PC3 collects the maintenance information from the target printing apparatus 4 (S06), the customer PC3 transmits the collected maintenance information to the server 2 (S07). When the server 2 acquires maintenance information from the customer PC3 (S08), the server 2 determines whether the maintenance process can be performed based on the acquired maintenance information (S09). Here, the server 2 determines that the maintenance process can be performed when the residual amount of each of the four colors of inks in the ink cartridges 62 is larger than the predetermined amount of the respective four colors of inks consumed by the maintenance process, and the free capacity of the maintenance box 78 is larger than the total value of the predetermined amount of the four colors of ink consumed by the maintenance process. For example, the server 2 determines that the maintenance process cannot be performed when the residual amount of ink in any one color of the four colors of inks in the ink cartridges 62 is smaller than the predetermined ink consumption of the color.

Figure 8:
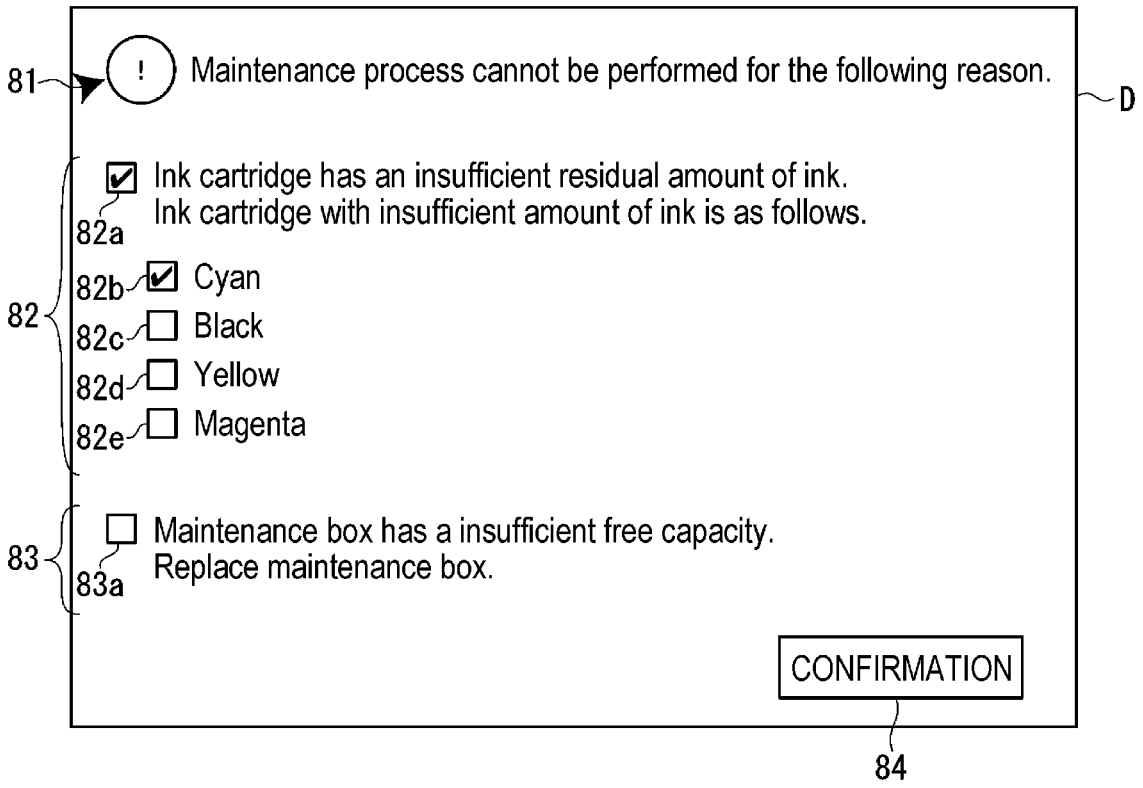
FIG. 8 is a diagram illustrating an example of an error display screen.

When it is determined that the maintenance process cannot be performed (S09: No), the server 2 displays the error display screen D on the support PC1 (S10). FIG. 8 is a diagram illustrating an example of the error display screen D. A first message 81 indicating that the maintenance process cannot be performed, a second message 82 making notification that the ink cartridge 62 has the insufficient residual amount of ink, a third message 83 making notification that the maintenance box 78 has the insufficient free capacity, and a confirmation button 84 are displayed on the error display screen D.

The second message 82 includes a first check box 82*a*, a second check box 82*b*, a third check box 82*c*, a fourth check box 82*d*, and a fifth check box 82*e*. The first check box 82*a* is in the checked stated when the maintenance process cannot be performed due to the insufficient residual amount of ink in the ink cartridge 62. In addition, depending on the ink color of the ink cartridge 62 with the insufficient residual ink amount, any one or more of the second check box 82*b*, the third check box 82*c*, the fourth check box 82*d*, and the fifth check box 82*e* are in the checked stated. In addition, the third message 83 includes a sixth check box 83*a*. The sixth check box 83*a* is in the checked stated when the maintenance process cannot be performed due to the insufficient free capacity of the maintenance box 78. When the operator of the support PC1 validates the first message 81, the second message 82, and the third message 83, and selects the confirmation button 84, the error display screen D is hidden from view.

On the other hand, when it is determined that the maintenance process can be performed (S09: Yes), the server 2 instructs the customer PC3 to perform the maintenance process (S11). The customer PC3 receives the instruction from the server 2 and instructs the printing apparatus 4 to perform the maintenance process (S12). The printing apparatus 4 performs the maintenance process according to the instruction from the customer PC3 (S13).

On the other hand, after instructing the printing apparatus 4 to perform the maintenance process, the customer PC3 monitors the completion of the maintenance process (S14). Specifically, the customer PC3 monitors the completion of the maintenance process by monitoring the status of the printing apparatus 4. When the customer PC3 acquires the status indicating the completion of the maintenance process from the printing apparatus 4, the customer PC3 transmits a completion notification indicating the completion of the maintenance process to the server 2 (S15). When the server 2 acquires the completion notification from the customer PC3 (S16), the server 2 displays, on the support PC1, the completion message indicating the completion of the maintenance process (S17).

Figure 7:
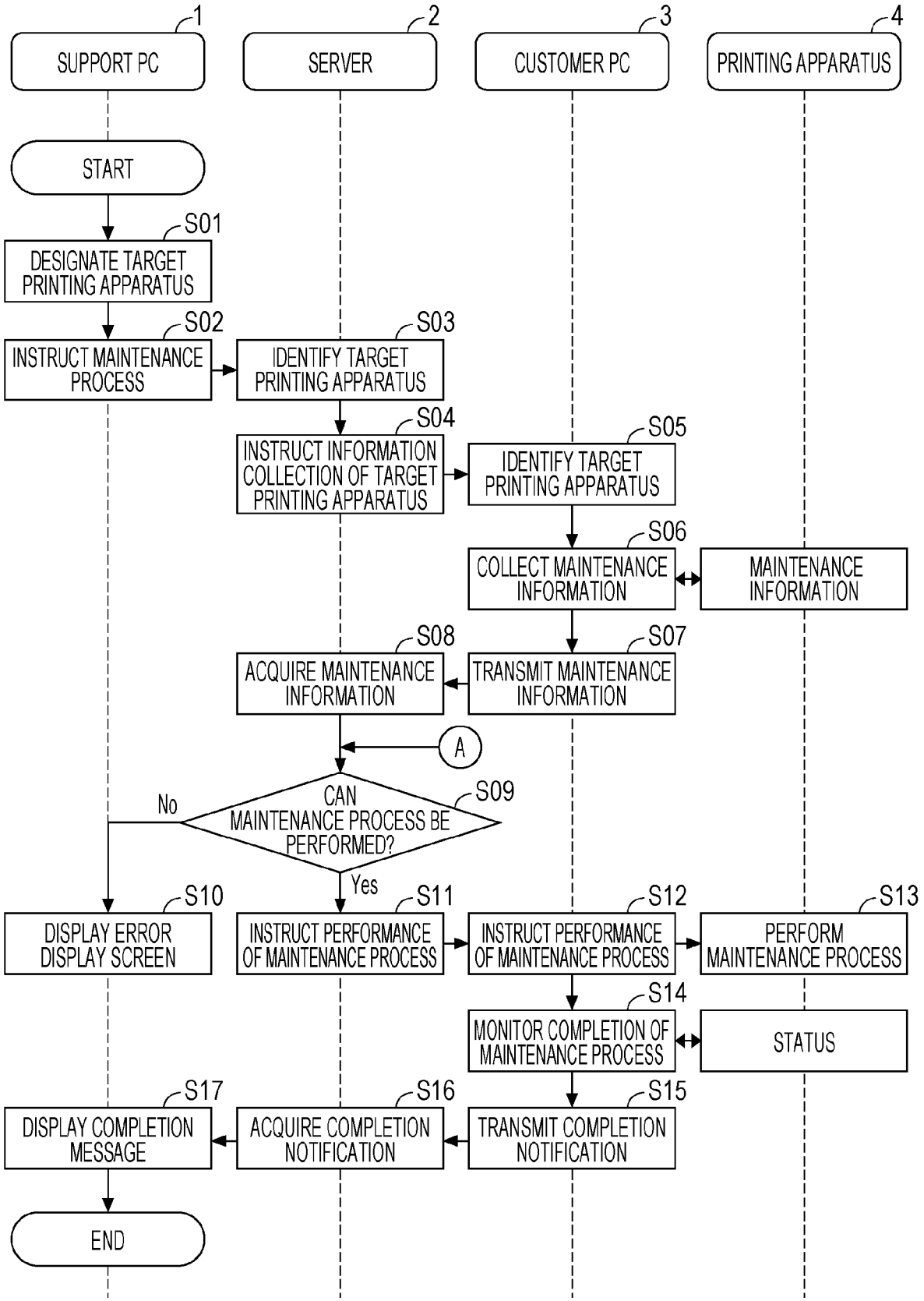
FIG. 7 is a flowchart showing a flow of a series of processes including a maintenance process by the first printing system.

Although not specifically shown, when the customer PC3 cannot acquire the status indicating the completion of the maintenance process from the printing apparatus 4 in S14 of the flowchart of FIG. 7, the customer PC3 transmits a notification to the server 2 that the maintenance process has not been completed, and the server 2 displays an error message to that effect on the support PC1.

As explained above, according to the first printing system SY1 of the first embodiment, the server 2 communicates with the customer PC3 via the network NW, and determines whether the maintenance process can be performed based on the maintenance information of the printing apparatus 4 acquired from the customer PC3. When it is determined that the maintenance process can be performed, the server 2 instructs the customer PC3 to perform the maintenance process of the printing apparatus 4, so that the maintenance process can be performed by the printing apparatus 4 at a remote location.

In this way, the service provider can improve the efficiency of service support related to the maintenance service of the printing apparatus 4 by performing the remote maintenance of the printing apparatus 4. In addition, the customer also has the merit that the downtime of the printing apparatus 4 related to the maintenance process can be reduced.

In addition, the maintenance information includes the residual ink amount information and the free capacity information, so that it is possible to prevent the residual amount of ink in the ink cartridge 62 of the printing apparatus 4 from being depleted, or the free capacity of the maintenance box 78 from being lost when instructing the maintenance process from server 2.

In addition, the server 2 acquires, as the residual ink amount information, information indicating the residual amount of each color of ink in the ink cartridge 62, and when the residual amount of ink in the ink cartridge 62 in any one of the colors is expected to be sufficient, it is determined that the maintenance process cannot be performed, so that it is possible to prevent the residual amount of ink in the ink cartridge 62 in any one of the colors from being depleted by the maintenance process.

Second Embodiment

Next, a second embodiment of the present disclosure will be described with reference to FIGS. 9 and 10. A second printing system SY2 according to the second embodiment has a system configuration in which the customer PC3 is omitted from the first printing system SY1 according to the first embodiment. Hereinafter, a description will be given focusing on differences from the first embodiment. In the present embodiment, the same components as those in the first embodiment are denoted by the same reference numerals, and detailed description thereof is omitted. Moreover, the modification applied to the component similar to the first embodiment is applied similarly to this embodiment.

Figure 9:
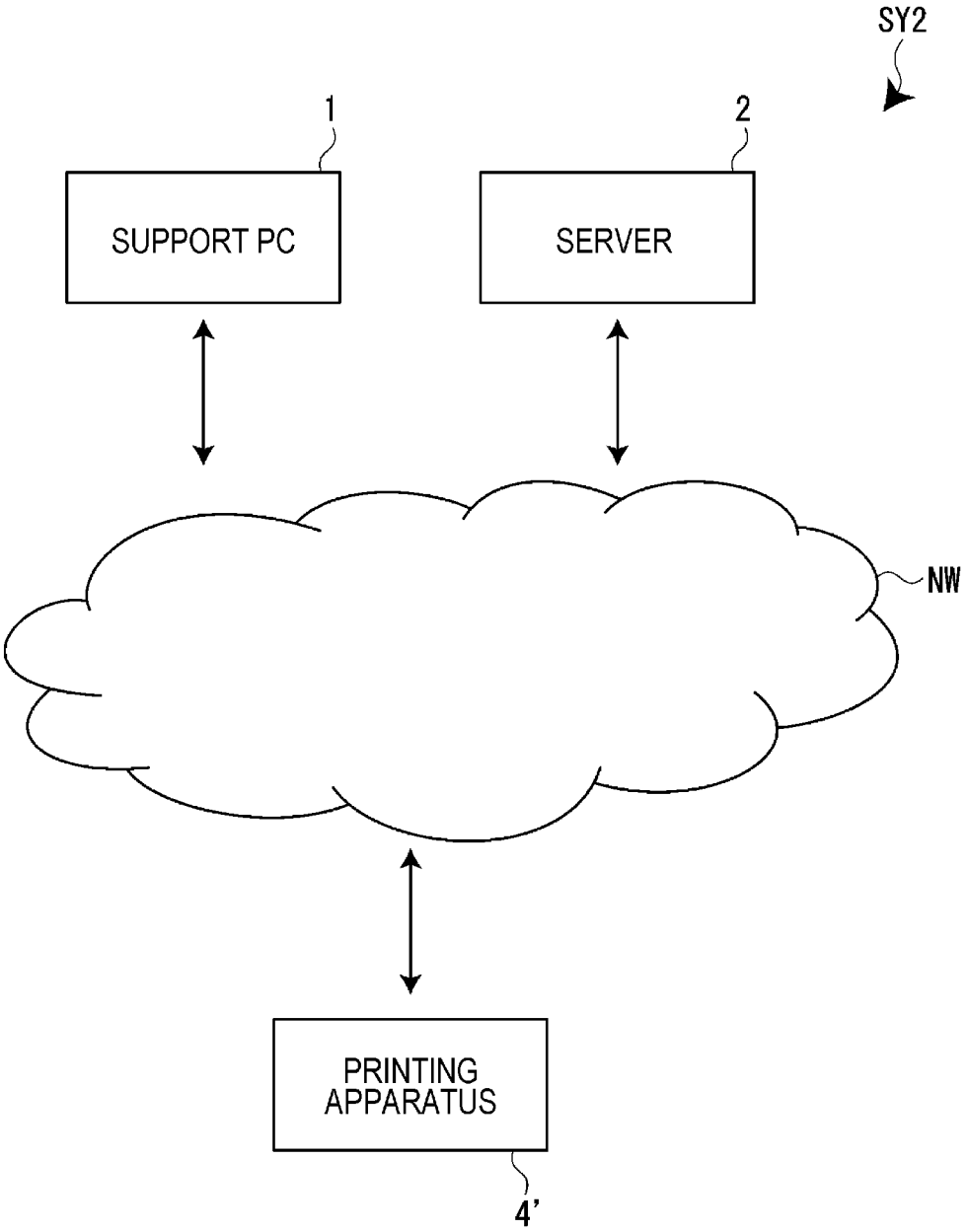
FIG. 9 is a system configuration diagram of a second printing system.

FIG. 9 is a system configuration diagram of the second printing system SY2. The second printing system SY2 includes a support PC1, a server 2, and a printing apparatus 4', which are coupled via the network NW. That is, the server 2 according to the present embodiment communicates with the printing apparatus 4' without going through the customer PC3. Therefore, the printing apparatus 4' according to the present embodiment includes the client side control program 36*b* (see FIG. 4) in the printing apparatus storage unit 47 (see FIG. 5) of the printing apparatus 4 according to the first embodiment. In addition, the server 2 according to the present embodiment stores, in the database 23*d*, a printing apparatus table in which the device name of the printing apparatus 4' capable of communicating with the server 2 and the address thereof are associated with each other.

Figure 10:
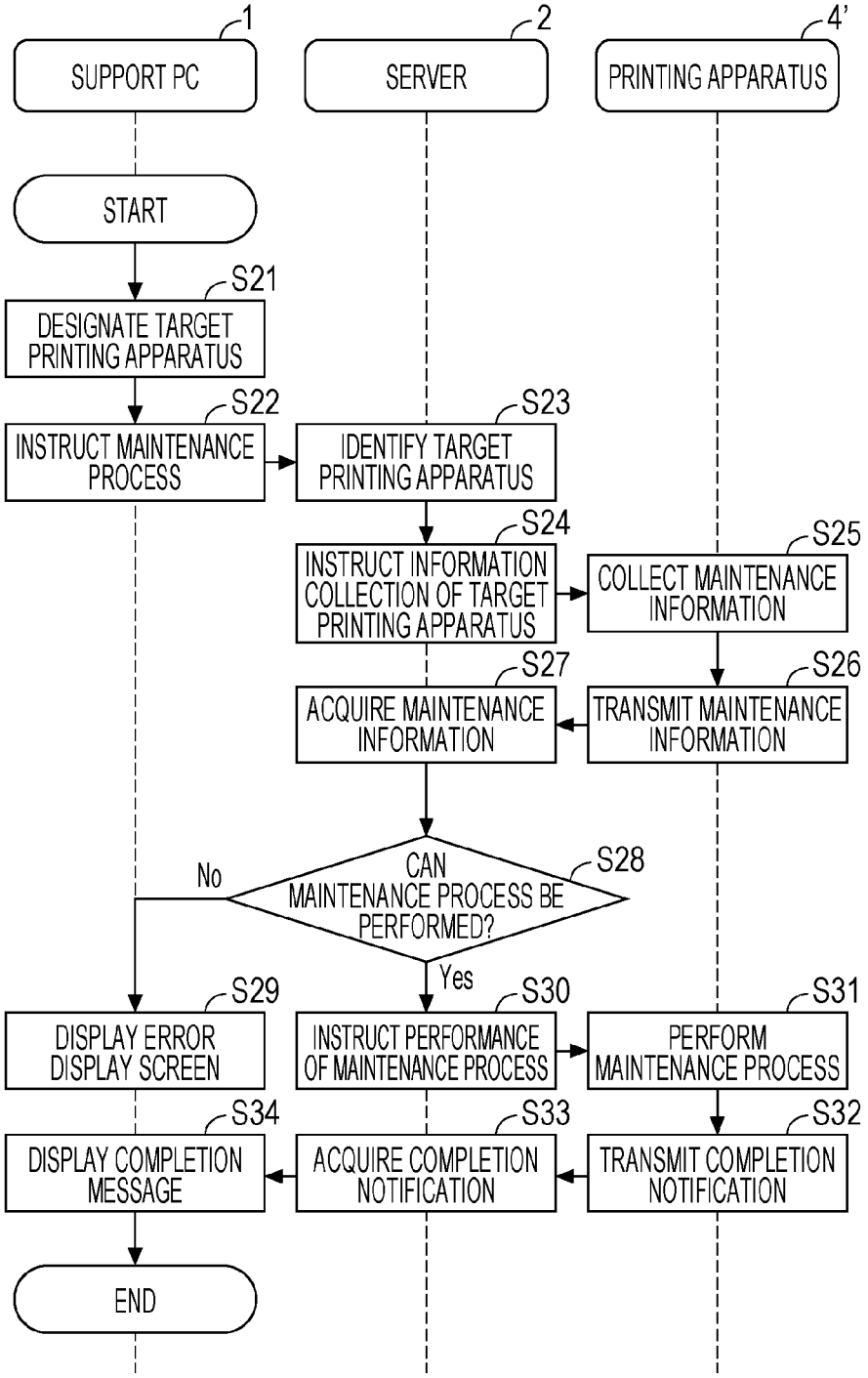
FIG. 10 is a flowchart showing a flow of a series of processes including a maintenance process by the second printing system.

FIG. 10 is a flowchart showing a flow of a series of processes when the second printing system SY2 causes the printing apparatus 4' to perform the maintenance process. S21 to S23 are the same as S01 to S03 in the flowchart (see FIG. 7) showing the processing of the first printing system SY1. The server 2 instructs the target printing apparatus 4' designated by the support PC1 to collect information (S24). At this time, the server 2 refers to the printing apparatus table stored in the database 23*d* and instructs the target printing apparatus 4' of the address designated by the support PC1 to perform information collection.

The printing apparatus 4' collects maintenance information of its own apparatus based on an instruction from the server 2 (S25), and transmits the collected maintenance information to the server 2 (S26). When the server 2 acquires the maintenance information from the printing apparatus 4' (S27), the server 2 determines whether the maintenance process can be performed based on the acquired maintenance information (S28). When it is determined that the maintenance process cannot be performed (S28: No), the server 2 displays the error display screen D (see FIG. 8) on the support PC1 (S29). When it is determined that the maintenance process can be performed (S28: Yes), the server 2 instructs the printing apparatus 4' to perform the maintenance process (S30). The printing apparatus 4' performs the maintenance process according to the instruction from the server 2 (S31), and transmits a completion notification indicating the completion of the maintenance process to the server 2 (S32). When the server 2 acquires the completion notification from the printing apparatus 4' (S33), the server 2 displays a completion message indicating the completion of the maintenance process on the support PC1 (S34).

As explained above, according to the second printing system SY2 of the second embodiment, the server 2 communicates with the printing apparatus 4' via the network NW, and determines whether the maintenance process can be performed based on the maintenance information acquired from the printing apparatus 4'. When it is determined that the maintenance process can be performed, the server 2 instructs the printing apparatus 4' to perform the maintenance process, so that the maintenance process can be performed by the printing apparatus 4' at a remote location. That is, according to the second printing system SY2, the same action and effect as in the first embodiment can be achieved with a simple configuration in which the customer PC3 is omitted from the first printing system SY1 according to the first embodiment.

Although two embodiments have been described above, the following modifications can be applied without limited to these embodiments.

Modification 1

Although the maintenance process is based on a predetermined sequence, that is, the maintenance process performed by the printing apparatus 4 is one type, in each of the above embodiments, the printing apparatus 4 may be capable of performing a plurality of types of maintenance processes. Further, in this case, the server 2 may acquire nozzle information indicating the state of the ink nozzles 66 provided in the print head 64 of the printing apparatus 4 and determines the type of maintenance process based on the acquired nozzle information.

Figure 11:
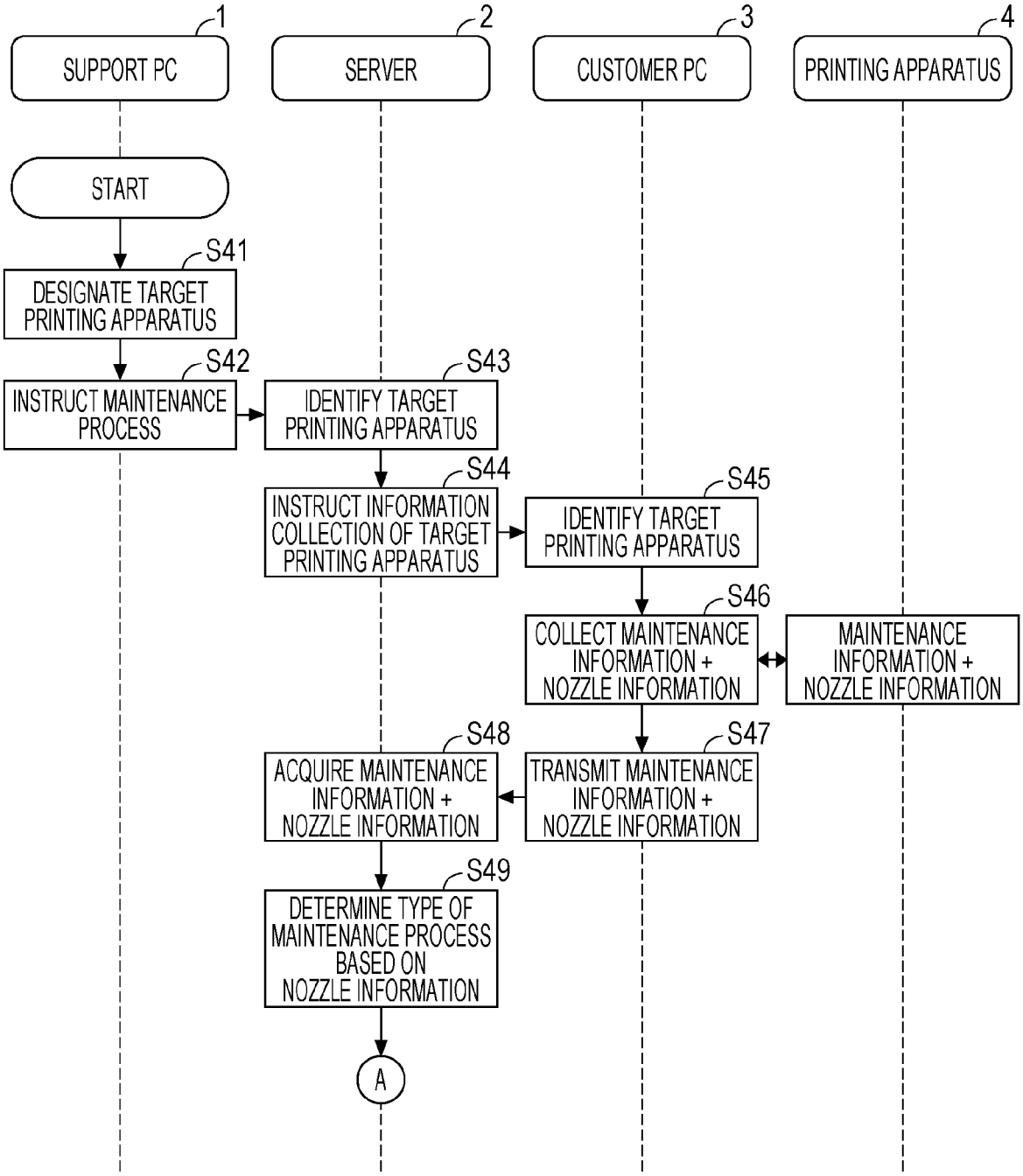
FIG. 11 is a flowchart showing a flow of a series of processes including a maintenance process according to Modification 1.

FIG. 11 is a flowchart showing a flow of a series of processes including a maintenance process according to this modification. Here, a case where the system configuration of the first printing system SY1 is used is illustrated. It is assumed that information obtained by detecting, by an actuator using a piezo element, residual vibration due to the pressure change in the cavity filled with ink supplied from the ink cartridge 62 in the print head 64 is used as nozzle information indicating the state of the ink nozzles 66. By using this method, it is possible to acquire nozzle information whether ink is being ejected or ink is not being ejected. In addition, various defects of the ink nozzles 66 such as air bubbles in the ink nozzles 66, the increased viscosity of ink, and the foreign matter adhesion can be detected by the detection signal obtained by detecting, by the actuator, residual vibration due to the pressure change in the cavity.

In the flowchart of FIG. 11, S41 to S45 are the same as S01 to S05 in the flowchart of the first embodiment shown in FIG. 7. The customer PC3 collects maintenance information and nozzle information from the target printing apparatus 4 on which the maintenance process is to be performed (S46). As described above, the customer PC3 collects, as nozzle information, the detection signal obtained by detecting, by the actuator, residual vibration due to the pressure change in the cavity. When the customer PC3 collects the maintenance information and the nozzle information from the target printing apparatus 4, the customer PC3 transmits the acquired information to the server 2 (S47). When the server 2 acquires the maintenance information and the nozzle information from the customer PC3 (S48), the server 2 determines the type of maintenance process based on the acquired nozzle information (S49).

Here, the type of maintenance process is distinguished by, for example, a flushing process having a plurality of levels of intensity based on a difference in ink consumption when performing the flushing process among the maintenance processes. For example, when the printing apparatus 4 may be capable of performing any of a normal flushing process in which the first ink consumption is required and a powerful flushing processes in which the second ink consumption is required where the second ink consumption is larger than the first ink consumption, the server 2 determines either of the normal flushing process or the powerful flushing process based on the acquired nozzle information. Here, for example, when acquiring nozzle information indicating defects such as air bubbles in the ink nozzles 66, increased viscosity of ink, and foreign matter adhesion, it is determined that the powerful flushing process is performed, and when acquiring nozzle information that does not indicate these defects, it is determined that the normal flushing process is performed.

When the server 2 determines the type of maintenance process (S49), the process proceeds to S09 in the flowchart of the first embodiment shown in FIG. 7, and it is determined whether the determined type of maintenance process can be performed based on the acquired maintenance information.

As explained above, according to this modification, the server 2 determines the type of maintenance process based on the nozzle information indicating the state of the ink nozzles 66, and determines whether the determined type of maintenance process can be performed, so that the server 2 can cause the printing apparatus 4 to perform the maintenance process suitable for the state of the ink nozzles 66. Further, since the information detected by the actuator for ejecting ink is used as nozzle information, it is not necessary to provide the printing apparatus 4 with a special configuration for detecting the state of the ink nozzles 66.

Modification 1

The server 2 may use, as nozzle information, information other than information detected by the actuator. For example, information obtained by optically detecting, for each ink nozzles 66, a state in which no ink droplet is ejected from the ink nozzles 66 may be used as the nozzle information. In addition, information obtained by detecting an ejection failure of the ink nozzles 66 by a known method may be used as the nozzle information.

Modification 2

When the printing apparatus 4 is capable of performing a plurality of types of maintenance processes, the type of maintenance process may be selectable by the operator of the support PC1. In this case, the server 2 provides the support PC1 with a maintenance process selection screen as a WEB page, and accepts selection of the maintenance process on the maintenance process selection screen. Further, the server 2 determines whether the accepted type of maintenance process can be performed based on the acquired maintenance information. According to this configuration, the operator of the support PC1 can select a desired type of maintenance process from among a plurality of types of maintenance processes.

Further, when it is determined that the accepted type of maintenance process cannot be performed based on the acquired maintenance information, the server 2 may make notification of the type of maintenance process that can be performed. For example, it is assumed that the printing apparatus 4 is capable of performing either the normal maintenance process or the powerful maintenance process, the operator of the support PC1 selects the powerful maintenance process, and the server 2 determines from the maintenance information that the powerful maintenance process cannot be performed, but the normal maintenance process can be performed. In this case, the server 2 may display, on the support PC1, a message indicating that the powerful maintenance process cannot be performed, but the normal maintenance process can be performed. According to this configuration, the operator of the support PC1 can grasp the type of maintenance process that can be performed.

Modification 3

In the above embodiments, the server 2 acquires, as maintenance information, the residual ink amount information and the free capacity information. The server 2 may acquire only one of them, and may determine whether the maintenance process can be performed. Alternatively, information other than the residual ink amount information and the free capacity information may be acquired as the maintenance information. Examples of the maintenance information may include the elapsed time from the previous maintenance process, the number of printed sheets printed after the previous maintenance process, the number of replacements of the ink cartridge 62, the ink type, the ambient temperature of the printing apparatus 4, the ambient humidity of the printing apparatus 4 and the like. Further, the server 2 may determine the type of maintenance process in consideration of the above maintenance information.

Modification 4

In the embodiments described above, the server 2 performs the flushing process and the suction process as the maintenance process, but may perform only one of the processes. Alternatively, a process other than the flushing process and the suction process may be performed as the maintenance process. Examples of the maintenance process may include a wiping process of wiping the lower face 65 of the print head 64, that is, the nozzle hole forming face of the print head 64, and a micro-vibration process of driving the actuator to vibrate the tip of the ink nozzles 66 to such an extent that ink is not ejected.

Modification 5

In addition, in the flushing process as the type of maintenance process, the server 2 may determine any of three flushing processes instead of determining any of the two types of flushing processes which are the normal flushing process and the powerful flushing process. The types of maintenance processes may be distinguished not only by the difference in ink consumption in the flushing process but also by the difference in the maintenance process sequence. The difference in the sequence refers to, for example, in what order each maintenance process such as a flushing process, a suction process, and a wiping process are performed, how much time is taken, and how many times it is performed.

Modification 6

Further, the server 2 may determine the type of maintenance process based on the acquired maintenance information and the acquired nozzle information. For example, the server 2 may determine which of the normal flushing process and the powerful flushing process is performed based on the acquired maintenance information and the acquired nozzle information.

Modification 7

In the embodiments described above, the server 2 instructs the printing apparatus 4 to collect the information based on the maintenance process instruction from the support PC1, but may instruct the printing apparatus 4 to collect the information at a predetermined timing. Examples of the predetermined timing may include when the server 2, the customer PC3, or the printing apparatus 4 is started, or a predetermined time, or regular time intervals. Alternatively, the nozzle information shown in Modification 1 may be acquired at a predetermined timing, and when a defect of the ink nozzles 66 is detected, collection of the maintenance information of the printing apparatus 4 may be instructed.

Modification 8

In the above embodiments, the server 2 acquires the maintenance information when instructing the printing apparatus 4 to collect information. At this time, the server 2 may acquire the status of the printing apparatus 4 at the same time, and when it is determined from the acquired status that the maintenance process cannot be performed, the server 2 may display an error message indicating the fact on the support PC1. For example, when the server 2 acquires a status indicating that the printing apparatus 4 is performing printing or a status indicating that an error has occurred in the printing apparatus 4, the server 2 determines that the maintenance process cannot be performed.

Modification 9

The method of performing the respective processes of the support PC1, the server 2, the customer PC3 and the printing apparatus 4 described in the above embodiments and the above modifications, programs for executing the respective processes of the support PC1, the server 2, the customer PC3 and the printing apparatus 4, and a computer-readable recording medium on which the programs are recorded are also included in the scope of the right of the disclosure. Moreover, the configuration may be a combination of the respective embodiments and the respective modifications.

Modification 10

In addition, the ink jet method of the printing apparatus 4 is not limited to the piezo method using a piezo element as an actuator, and other methods such as an electrostatic actuator method and a bubble method may be employed. Further, the printing method of the printing apparatus 4 is not limited to the serial head method, and other methods such as a line head method may be employed. Further, instead of the support PC1 and the customer PC3, various pieces of information processing terminals such as various tablet terminals and smartphones may be used. The ink cartridge 62 may be an ink container such as a pouch-type ink pack or an ink tank that stores ink poured from an ink bottle. In addition, the processes of the support PC1, server 2, customer PC3, and printing apparatus 4 such as the processes performed with the cooperation of hardware and software can be appropriately changed without departing from the gist of the disclosure, for example.

APPENDIX

Hereinafter, a printing system, a server, a control method of the printing system, and a program will be additionally described. The first printing system SY1 includes the printing apparatus 4 including the ink container 62 and the server 2 coupled to the printing apparatus 4 via the network NW. The server 2 includes the server controller 21 that acquires maintenance information including residual ink amount information indicating an residual amount of ink in the ink container 62 of the printing apparatus 4, determines whether a maintenance process can be performed based on the acquired maintenance information, and instructs the printing apparatus 4 to perform the maintenance process when it is determined that the maintenance process can be performed.

The server 2 is coupled to the printing apparatus 4 including the ink container 62 via a network NW. The server includes the server controller 21 that acquires maintenance information including residual ink amount information indicating an residual amount of ink in the ink container 62 of the printing apparatus 4, determines whether a maintenance process can be performed based on the acquired maintenance information, and instructs the printing apparatus 4 to perform the maintenance process when it is determined that the maintenance process can be performed.

In a method of controlling the first printing system SY1, the first printing system SY1 includes the printing apparatus 4 including an ink container 62 and the server 2 coupled to the printing apparatus 4 via the network NW. The server 2 performs the method. The method includes acquiring maintenance information including residual ink amount information indicating an residual amount of ink in the ink container 62 of the printing apparatus 4, determining whether a maintenance process can be performed based on the acquired maintenance information, and instructing the printing apparatus 4 to perform the maintenance process when it is determined that the maintenance process can be performed.

In a non-transitory computer-readable storage medium storing the server side control program 23*c*, the program causes the server 2 coupled to the printing apparatus 4 including the ink container 62 via the network NW to acquire maintenance information including residual ink amount information indicating an residual amount of ink in the ink container 62 of the printing apparatus 4, determine whether a maintenance process can be performed based on the acquired maintenance information, and instruct the printing apparatus 4 to perform the maintenance process when it is determined that the maintenance process can be performed.

According to this configuration, the server 2 acquires maintenance information including residual ink amount information indicating the residual amount of ink in the ink container 62 from the printing apparatus 4 coupled via the network NW, and determines whether the maintenance process can be performed based on the acquired maintenance information. When it is determined that the maintenance process can be performed, the server 2 instructs the printing apparatus 4 to perform the maintenance process, so that the user can causes the printing apparatus 4 at a remote location to perform the maintenance process. In addition, the server 2 determines whether the maintenance process can be performed based on the maintenance information, so that it is possible to prevent the residual amount of ink in the ink container 62 of the printing apparatus 4 from being depleted by instructing the maintenance process. "The printing apparatus 4 and the server 2 are coupled via the network NW" means a concept including not only the case where the printing apparatus 4 and the server 2 are directly coupled, but also the case where the printing apparatus 4 and the server 2 are coupled via some kind of relay device.

In the first printing system SY1, it is preferable that the maintenance process include at least one of the flushing process of performing waste ejection of ink from the ink nozzles 66 provided in the print head 64 of the printing apparatus 4 and the suction process of sucking ink from the ink nozzles 66.

According to this configuration, the server 2 can cause the printing apparatus 4 to perform at least one of the flushing process and the suction process as the maintenance process.

In the first printing system SY1, the maintenance information preferably includes the free capacity information indicating the free capacity of the maintenance box 78 that stores the ink discharged in the maintenance process.

According to this configuration, the server 2 determines whether the maintenance process can be performed based on the free capacity information indicating the free capacity of the maintenance box 78, so that it is possible to prevent the free capacity of the maintenance box 78 of the printing apparatus 4 from being depleted by instructing the maintenance process.

In the first printing system SY1, it is preferable that the printing apparatus 4 be capable of performing a plurality of types of maintenance processes, and the server controller 21 accept, among the plurality of types of maintenance processes, selection of any type of maintenance process, determine whether the accepted type of maintenance process can be performed based on the acquired maintenance information, and when it is determined that the maintenance process cannot be performed, make notification of the type of maintenance process that can be performed.

According to this configuration, since the server 2 accepts selection of any type of maintenance process among a plurality of types of maintenance processes, so that the user can select a desired type of maintenance process. When the server 2 determines that the maintenance process selected by the user cannot be performed, the server 2 makes notification of the type of maintenance process that can be performed, so that the user can grasp the type of maintenance process that can be performed.

In the first printing system SY1, it is preferable that the printing apparatus 4 be capable of performing a plurality of types of maintenance processes, and the server controller 21 acquire nozzle information indicating the state of the ink nozzles 66 provided in the print head 64 of the printing apparatus 4, determine the type of maintenance process based on the acquired nozzle information, and determine whether the determined type of maintenance process can be performed based on the acquired maintenance information. In this case, it is preferable that the printing apparatus 4 change the pressure in the cavity filled with ink of the print head 64 by driving the actuator, and eject ink from the ink nozzles 66 communicating with the cavity, and the nozzle information be information obtained by detecting, by the actuator, residual vibration due to the pressure change in the cavity.

According to this configuration, the server 2 determines the type of maintenance process based on the nozzle information indicating the state of the ink nozzles 66 provided in the print head 64 of the printing apparatus 4, and determines whether the determined type of maintenance process can be performed, so that the server 2 can cause the printing apparatus 4 to perform the maintenance process suitable for the state of the ink nozzles 66. Further, when the information detected by the actuator for ejecting ink is used as nozzle information, it is not necessary to provide the printing apparatus 4 with a special configuration for detecting the state of the ink nozzles 66.

In the first printing system SY1, it is preferable that the printing apparatus 4 be capable of performing a flushing process having a plurality of levels of intensity as at least part of the maintenance process, and the server controller 21 determine which flushing process is performed, based on the acquired nozzle information, among a normal flushing process in which the first ink consumption is required and a powerful flushing processes in which the second ink consumption is required where the second ink consumption is larger than the first ink consumption.

According to this configuration, the server 2 can appropriately determine which flushing process is performed among the normal flushing process and the powerful flushing process based on nozzle information indicating the state of the ink nozzles 66 provided in the print head 64 of the printing apparatus 4.

In the first printing system SY1, it is preferable that the printing apparatus 4 include a plurality of ink containers 62 corresponding to a plurality of colors, and the residual ink amount information be information indicating the residual amount of each color of ink in the ink container 62.

According to this configuration, since it is determined whether the maintenance process can be performed based on information indicating the residual amount of each color of ink in the ink containers 62 corresponding to a plurality of colors, it is determined that the maintenance process cannot be performed when the residual amount of any one color of ink in the ink containers 62 is expected to be depleted, so that it is possible to prevent the residual amount of any one color of ink in the ink containers 62 from being depleted by the maintenance process.

What is claimed is:

1. A printing system comprising:

a printing apparatus including an ink container; and a server coupled to the printing apparatus via a network, wherein the server includes a controller that acquires maintenance information including residual ink amount information indicating a residual amount of ink in the ink container of the printing apparatus, determines whether a maintenance process is configured to be performed based on the acquired maintenance information, and instructs the printing apparatus to perform the maintenance process when it is determined that the maintenance process is configured to be performed, wherein, the printing apparatus is configured to perform a plurality of types of the maintenance processes having a plurality of levels of intensity, wherein, the controller acquires nozzle information indicating a state of an ink nozzle provided in a print head of the printing apparatus, determines a type of the maintenance process based on the acquired nozzle information, and determines whether the determined type of the maintenance process is configured to be performed based on the acquired maintenance information, wherein, the controller determines which maintenance process should be performed, based on the acquired nozzle information, among a normal level maintenance process and a powerful level maintenance process, and wherein, when the controller determines that the accepted type of maintenance process cannot be performed based on the acquired maintenance information, the server provides a notification of the type of maintenance process that can be performed.

2. The printing system according to claim 1, wherein the maintenance process includes at least one of a flushing process of ejecting ink in order to prevent an ejection failure separately from image formation on a print medium from an ink nozzle provided in a print head of the printing apparatus and a suction process of sucking ink from the ink nozzle.

3. The printing system according to claim 2, wherein the maintenance information includes free capacity information indicating a free capacity of a maintenance box that stores ink discharged by the maintenance process.

4. The printing system according to claim 1, wherein the printing apparatus is configured to perform a plurality of types of the maintenance processes, and wherein the controller accepts, among the plurality of types of the maintenance processes, selection of any type of the maintenance process, determines whether the accepted type of the maintenance process is configured to be performed based on the acquired maintenance information, and makes notification of a type of the maintenance process that is configured to be performed when it is determined that the maintenance process is not configured to be performed.

5. The printing system according to claim 1, wherein the printing apparatus is configured to perform, as at least part of the maintenance process, a flushing process having a plurality of levels of intensity, and wherein the controller determines which flushing process is performed, based on the acquired nozzle information, among a normal flushing process in which a first ink consumption is required and a powerful flushing processes in which a second ink consumption is required, the second ink consumption being larger than the first ink consumption.

6. The printing system according to claim 1, wherein the printing apparatus includes a plurality of the ink containers corresponding to a plurality of colors, and wherein the residual ink amount information is information indicating a residual amount of each color of ink in the ink container.

7. A server coupled to a printing apparatus including an ink container via a network, wherein the server includes a controller that acquires maintenance information including residual ink amount information indicating a residual amount of ink in the ink container of the printing apparatus, determines whether a maintenance process is configured to be performed based on the acquired maintenance information, and instructs the printing apparatus to perform the maintenance process when it is determined that the maintenance process is configured to be performed, wherein, the printing apparatus is configured to perform a plurality of types of the maintenance processes having a plurality of levels of intensity, wherein, the controller acquires nozzle information indicating a state of an ink nozzle provided in a print head of the printing apparatus, determines a type of the maintenance process based on the acquired nozzle information, and determines whether the determined type of the maintenance process is configured to be performed based on the acquired maintenance information, wherein, the controller determines which maintenance process should be performed, based on the acquired nozzle information, among a normal level maintenance process and a powerful level maintenance process, and wherein, when the controller determines that the accepted type of maintenance process cannot be performed based on the acquired maintenance information, the server provides a notification of the type of maintenance process that can be performed.

8. A method of controlling a printing system, the printing system including a printing apparatus including an ink container and a server coupled to the printing apparatus via a network, wherein the server performs the method, the method comprising:

acquiring maintenance information including residual ink amount information indicating a residual amount of ink in the ink container of the printing apparatus; and determining whether a maintenance process is configured to be performed based on the acquired maintenance information, and instructing the printing apparatus to perform the maintenance process when it is determined that the maintenance process is configured to be performed, wherein, the printing apparatus is configured to perform a plurality of types of the maintenance processes having a plurality of levels of intensity, wherein, the controller acquires nozzle information indicating a state of an ink nozzle provided in a print head of the printing apparatus, determines a type of the maintenance process based on the acquired nozzle information, and determines whether the determined type of the maintenance process is configured to be performed based on the acquired maintenance information, wherein, the controller determines which maintenance process should be performed, based on the acquired nozzle information, among a normal level maintenance process and a powerful level maintenance process, and wherein, when the controller determines that the accepted type of maintenance process cannot be performed based on the acquired maintenance information, providing a notification of the type of maintenance process that can be performed by the server.

* * * * *